US008985974B2

(12) United States Patent
Ozawa et al.

(10) Patent No.: US 8,985,974 B2
(45) Date of Patent: Mar. 24, 2015

(54) CONCENTRIC MULTI-STAGE VANE COMPRESSOR

(75) Inventors: Osamu Ozawa, Saku (JP); Shuzo Tsutsumi, Saku (JP)

(73) Assignee: Kashiyama Industries, Ltd., Nagano (JP)

( * ) Notice: Subject to any disclaimer, the term of this patent is extended or adjusted under 35 U.S.C. 154(b) by 107 days.

(21) Appl. No.: 13/810,781

(22) PCT Filed: Jan. 28, 2011

(86) PCT No.: PCT/JP2011/000488

§ 371 (c)(1),
(2), (4) Date: Jan. 17, 2013

(87) PCT Pub. No.: WO2012/011206

PCT Pub. Date: Jan. 26, 2012

(65) Prior Publication Data

US 2013/0115121 A1 May 9, 2013

(30) Foreign Application Priority Data

Jul. 22, 2010 (JP) ..... 2010-164506

(51) Int. Cl.
*F04C 23/00* (2006.01)
*F04C 18/04* (2006.01)
(Continued)

(52) U.S. Cl.
CPC ..... *F04C 18/04* (2013.01); *F04C 18/3441* (2013.01); *F04C 23/001* (2013.01); *F04C 29/0057* (2013.01); *F04C 18/0215* (2013.01)
USPC ..... 418/6; 418/5; 418/11; 418/52; 418/59; 418/60; 418/212

(58) Field of Classification Search
CPC ... F04C 18/3441; F04C 18/04; F04C 29/0057
USPC ..... 418/59, 11, 60, 212, 5, 6, 52
See application file for complete search history.

(56) References Cited

U.S. PATENT DOCUMENTS 406,099 A * 7/1889 Johnson ..... 417/384
465,050 A * 12/1891 Rand et al. ..... 417/355
(Continued)

FOREIGN PATENT DOCUMENTS

GB 1 470 563 A 4/1977
JP 38-013142 B1 7/1963
(Continued)

OTHER PUBLICATIONS

International Search Report (PCT/ISA/210) issued on Apr. 19, 2011, by the Japanese Patent Office as the International Searching Authority for International Application No. PCT/JP2011/000488.

*Primary Examiner* — Thomas Denion
*Assistant Examiner* — Xiaoting Hu
(74) *Attorney, Agent, or Firm* — Buchanan Ingersoll & Rooney PC

(57) ABSTRACT

Disclosed is a vane compressor in which cylinders concentrically formed at the side of a rotor are eccentrically inserted in ring-shaped spaces between cylindrical parts concentrically formed at the side of a stator. A pair of radially extending vane attachment grooves is formed in the rotor, and vanes are slidably attached in the vane attachment grooves. Compression chambers the volumes of which repeatedly increase and decrease with each rotation of the rotor are concentrically formed in multiple stages by the cylindrical parts of the stator, the cylinders of the rotor, and comb-tooth parts of the vanes. It is possible to realize a vane compressor in which compression chambers can be concentrically arranged in multiple stages in a simple structure by suppressing increase in the number of components to the minimum level.

17 Claims, 7 Drawing Sheets

(51) Int. Cl.

| | |
|---|---|
| ***F04C 18/344*** | (2006.01) |
| ***F04C 29/00*** | (2006.01) |
| ***F04C 18/02*** | (2006.01) |

(56) References Cited

U.S. PATENT DOCUMENTS

| | | | | | |
|---|---|---|---|---|---|
| 677,752 | A | * | 7/1901 | Bellas | 418/6 |
| 904,209 | A | * | 11/1908 | Lyons et al. | 418/57 |
| 940,817 | A | * | 11/1909 | McLean et al. | 418/6 |
| 1,098,458 | A | * | 6/1914 | Nelson | 418/6 |
| 1,872,361 | A | * | 8/1932 | Tackman | 91/11 |
| 1,940,384 | A | * | 12/1933 | Zoller | 418/254 |
| 1,967,957 | A | * | 7/1934 | Lucas | 418/22 |
| 2,073,101 | A | * | 3/1937 | Fox | 418/59 |
| 2,521,592 | A | * | 9/1950 | McManus | 418/6 |
| 4,638,954 | A | * | 1/1987 | Poss | 241/74 |
| 5,284,426 | A | | 2/1994 | Strikis et al. | |
| 5,375,985 | A | * | 12/1994 | Pipaloff | 418/6 |
| 2006/0177336 | A1 | * | 8/2006 | Hwang et al. | 418/59 |

FOREIGN PATENT DOCUMENTS

| | | | |
|---|---|---|---|
| JP | 50-007114 | A | 1/1975 |
| JP | 58-174187 | A | 10/1983 |
| JP | 62-102801 | U | 6/1987 |
| JP | 6-017778 | A | 1/1994 |
| JP | 6-280766 | A | 10/1994 |
| JP | 2006-342703 | A | 12/2006 |
| JP | 2009-197795 | A | 9/2009 |

* cited by examiner (a)
(b)
(c)
100A
INTAKE GAS
L
102
102a
103
103a
104A
104B
105
106
106c
107
112
120
121
122
123
123a
123b
124
124a
124b
125
125a
125b
137A
137a
137B
141
142
143
144
145
146
151
152
153
154
155
156
161
162
163
164
165
166
167

CONCENTRIC MULTI-STAGE VANE COMPRESSOR

TECHNICAL FIELD

The present invention relates to a vane compressor that can be readily and inexpensively adapted to a multistage arrangement with a minimal number of components, in order to improve compression performance.

BACKGROUND ART

It is well known that vane compressors, which are employed as vacuum pumps and the like, are equipped with a rotor that undergoes eccentric rotation within a cylinder (a stator), and vanes that are slidably pressed against the inner peripheral surface of the cylinder or the outer peripheral surface of the rotor by spring force. In association with rotation of the rotor, a stroke to draw a fluid into compression chambers partitioned by the vanes, and a stroke to compress and discharge the drawn-in fluid, are repeated. In a case in which it is desired to enhance the compression performance of vane compressors, typical practice is to link the vane compressors in a multistage arrangement in their axial direction, so as to obtain a high-compression ratio fluid from the vane compressor of the final stage.

In Patent Document 1, there is proposed a multistage rotary compressor of vane design in an attempt at a concentric multistage arrangement. In the multistage rotary compressor disclosed therein, a cylindrical post is arranged in concentric fashion in the interior of a housing, and an orbiting ring rotates eccentrically between the circular inner peripheral surface of the housing and the circular outer peripheral surface of the post. A pair of vanes pressed by spring force against the circular inner peripheral surface of the orbiting ring are attached to the post situated towards the center, and a pair of vanes pressed by spring force against the circular outer peripheral surface of the orbiting ring are attached to the housing situated towards the outside. Through eccentric rotation of the orbiting ring, a fluid is repeatedly compressed through the agency of compression chambers formed to the outer peripheral side and the inner peripheral side thereof.

PRIOR ART DOCUMENT

Patent Document

[Patent Document 1] Japanese Laid-Open Patent Application 6-280766

DISCLOSURE OF THE INVENTION

Problems to be Solved by the Invention

The feature of a conventional vane compressor equipped with a plurality of concentrically arranged compression chambers is basically one in which single-stage vane compressors are arranged in a concentric arrangement. Consequently, in a manner similar to the case in which vane compressors are connected in the axial direction in a multistage design, the number of components increases, and the structure becomes more complex as well. Moreover, it is difficult to attempt a three-stage or greater multistage design in which the compression chambers are arrayed concentrically.

With the foregoing in view, it is an object of the present invention to propose a vane compressor in which the compression chambers can be concentrically arranged in multiple stages in a simple structure, while suppressing increase in number of components to the minimum level.

Means Used to Solve the Above-Mentioned Problems

In order to solve the above-mentioned problem, the vane compressor of the present invention is constituted as described below. The reference numerals in parentheses show corresponding regions in the embodiment of the present invention discussed hereinbelow, and being appended merely as an aid to understanding, are not intended to limit the present invention to the embodiment herein.

Specifically, according to the present invention, there is provided a vane compressor (1A, 1B) having a stator (2); a rotor (3); and vanes (4) for dividing an interstice between the stator (2) and the rotor (3) into a plurality of compression chambers (53, 54); characterized in that the stator (2) is equipped, towards an outside from a center (2*a*) thereof, with a first circular inner peripheral surface (21*b*), a circular outer peripheral surface (21*a*), and a second circular inner peripheral surface (22*b*) arranged concentrically about the center (2*a*), an ring-shaped space (23) being formed between the circular outer peripheral surface (21*a*) and the second circular inner peripheral surface (22*b*);

the rotor (3) is equipped with a cylinder (35) centered about a center (3*a*) thereof, and with at least one pair of vane attachment grooves (37) that extend through the cylinder (35) in a radial direction thereof;

the cylinder (35) is arranged in an eccentric state in the ring-shaped space (23) of the stator (2), and divides the ring-shaped space (23) into an outer peripheral-side space (23*a*) and an inner peripheral-side space (23*b*);

the vanes (4) are slidably attached in the respective vane attachment grooves (37);

the vanes (4) are respectively equipped with first comb-tooth parts (41) and second comb-tooth parts (42) formed along a radial direction of the cylinder (35) of the rotor (3), at a predetermined distance from the center side thereof;

the first comb-tooth parts (41) are arranged to an inside of the first circular inner peripheral surface (21*b*), and the second comb-tooth parts (42) divide the outer peripheral-side space (23*a*) and the inner peripheral-side space (23*b*) respectively, into the plurality of compression chambers (53, 54) within the ring-shaped space (23); and due to centrifugal force acting on the vanes (4) in association with rotation of the rotor (3), at least the first comb-tooth parts (41) become pressed against the facing first circular inner peripheral surface (21*b*), and the vanes (4), guided by the first circular inner peripheral surface (21*b*), experience reciprocating slide motion along the vane attachment grooves (37).

In the vane compressor (1A, 1B) according to the present invention, when the rotor (3) rotates, the vanes (4) attached to the vane attachment grooves (37) rotate together with the rotor (3) as well. Because rotation of the rotor (3) is centered at a position that is eccentric with respect to the stator (2), the vanes (4) which are slidably attached to the rotor (3) experience reciprocating slide motion in a radial direction along the vane attachment grooves (37), and the second comb-tooth parts (42) translate along the ring-shaped space through the ring-shaped space (23) of the stator (2).

Specifically, the comb-tooth parts (41, 42) of the vanes (4), together with the rotor (3), rotate along the first circular inner peripheral surface (21*b*), the circular outer peripheral surface (21*a*), and the second circular inner peripheral surface (22*b*) of the stator (2). The compression chambers (53, 54), which are divided by the comb-tooth parts (41, 42), repeatedly increase and decrease in volume in association with rotation of the rotor (3). Consequently, when the discharge portion of the outside compression chamber (53) communicates with the intake port of the inside compression chamber (54), fluid compressed by the outside compression chamber can be delivered to the inside compression chamber and further compressed. Therefore, a multistage vane compressor can be realized simply by increasing the number of ring-shaped spaces on the stator side, the number of cylinders on the rotor side, and the number of second comb-tooth parts of the vanes. Specifically, improved compression performance can be realized in simple fashion.

In the vane compressor (1A, 1B) according to the present invention, the vanes (4) are slidably attached in the vane attachment grooves (37), whereby the vanes (4) are subjected to the action of centrifugal force acting thereon outwardly in a radial direction in association with rotation of the rotor (3), rotating the vanes (4) while drawing them outwardly in a radial direction. Consequently, it is possible for only the comb-tooth parts situated on the center side and having the slowest peripheral speed, specifically, the first comb-tooth parts (41), to be pressed from the inside by centrifugal force against the first circular inner peripheral surface (21*b*) on the stator (2) side to control the position of the vane (4) in a radial direction, while the outside second comb-tooth parts (42) are retained in a state facing the circular outer peripheral surface (21*a*) across a small gap.

Specifically, the vane compressor (1A, 1B) according to the present invention is characterized in that, with the first comb-tooth parts (41) of the vane (4) abutting against the first circular inner peripheral surface (21*b*), the second comb-tooth parts (42) face the second circular inner peripheral surface (22*b*) in a non-contacting state.

In so doing, only the first comb-tooth parts (41) which are closest to the rotor rotation center (3), in other words, the first comb-tooth parts (41) which have the slowest peripheral speed, come into contact with the first circular inner peripheral surface (21*b*) on the stator (2) side. Therefore, the amount of wear of sliding parts can be reduced, as compared with the case in which the outside second comb-tooth parts (42) having faster peripheral speed slide along the second circular inner peripheral surface (22*b*) on the stator (2) side, so the life of the components can be extended. Moreover, because the sliding resistance can be reduced, loss power can be reduced.

Here, in order for the first comb-tooth parts (41) and the first circular inner peripheral surface (21*b*) to be maintained in a state of contact, and for the second comb-tooth parts (42), the circular outer peripheral surface (21*a*), and the second circular inner peripheral surface (22*b*) to be maintained in a non-contacting state of confrontation across unchanging small gaps, the shapes of the first circular inner peripheral surface (21*b*), the circular outer peripheral surface (21*a*), and the second circular inner peripheral surface (22*b*) are defined by the rotation trajectories of those regions of the first and second comb-tooth parts (41, 42) of the vanes (4) that face these surfaces, or by approximate curves of these rotation trajectories. The rotation trajectories of these comb-tooth parts are shaped like an ellipse slightly flattened with respect to a true circle. Consequently, the inner peripheral surfaces and outer peripheral surfaces which are defined by the rotation trajectories of the comb-tooth parts, or by approximate curves thereof, are herein expressed as "circular inner peripheral surfaces" and "circular outer peripheral surfaces", respectively.

Next, according to the present invention, in order to further minimize wear between the vanes on the rotor side and the first circular inner peripheral surface on the stator side and minimize slide resistance between them to an even greater extent, a first cylindrical part (21B) to which the first circular inner peripheral surface (21*b*) is equipped is rotatably supported about the center thereof by the stator (2).

Because the first cylindrical part (21B), which functions as a vane guide that controls the reciprocating slide motion of the vanes (4), is rotatable, the part turns in tandem with the vanes in association with rotation of the vanes (4). Between the first cylindrical part (21B) and the vanes (4), slip is generated in association with eccentric rotation of the rotor (3); however, the slip rate can be significantly lower, as compared with the case in which the vane guide is stationary. Therefore, wear and slide resistance between these parts can be significantly reduced.

Next, according to the present invention, there is provided a vane compressor (100, 100A) having a stator (102); a rotor (103); and a vane (104) for dividing an interstice between the stator (102) and the rotor (103) into a plurality of compression chambers (153-156); characterized in that the stator (102) is equipped, towards an outside from a center (102*a*) thereof, with a first circular outer peripheral surface (120*a*), a first circular inner peripheral surface (121*b*), a second circular outer peripheral surface (121*a*), and a second circular inner peripheral surface (122*b*) arranged concentrically about the center (102*a*), a first ring-shaped space (123) being formed between the first circular outer peripheral surface (120*a*) and the first circular inner peripheral surface (121*b*), and a second ring-shaped space (124) being formed between the second circular outer peripheral surface (121*a*) and the second circular inner peripheral surface (122*b*);

the rotor (103) is equipped, towards an outside from a center (103*a*) thereof, with a first cylinder (131) and a second cylinder (132) arranged concentrically and centered on the center (103*a*), and with at least one vane attachment groove (137) extending through the first and second cylinders (131, 132) in a diametrical direction thereof;

the first cylinder (131) is arranged in an eccentric state in the first ring-shaped space (123), and divides the first ring-shaped space (123) into an outer peripheral-side space (123*a*) and an inner peripheral-side space (123*b*);

the second cylinder (132) is arranged in an eccentric state in the second ring-shaped space (124), and divides the second ring-shaped space (124) into an outer peripheral-side space (124*a*) and an inner peripheral-side space (124*b*);

the vanes are equipped with a pair of first comb-tooth parts (141, 142) and a pair of second comb-tooth parts (143, 144) formed at point-symmetrical positions with respect to the center, towards either end from the center in a lengthwise direction thereof;

the first comb-tooth parts (141, 142) contact the first circular outer peripheral surface (120*a*) from both sides, as well as dividing the outer peripheral-side space (123*a*) and the inner peripheral-side space (123*b*) of the first ring-shaped space (123) into the plurality of compression chambers (155, 156);

the second comb-tooth parts (143, 144) divide the outer peripheral-side space (124*a*) and the inner peripheral-side space (124*b*) of the second ring-shaped space (124) into the plurality of compression chambers (153, 154); and the vane (104) experiences reciprocating slide motion along the vane attachment grooves (137), due to sliding of the first comb-tooth parts (141, 142) of the vane (104) along the first circular outer peripheral surface (120*a*) in association with rotation of the rotor (103).

The stator (102) may be equipped with: a cylindrical or cylindrical solid vane guide (120) equipped with the first circular outer peripheral surface (120*a*); a first cylindrical part (121) arranged concentrically to an outside thereof, and equipped with the first circular inner peripheral surface (121*b*) and the second circular outer peripheral surface (121*a*); and a second cylindrical part (122) arranged concentrically to an outside thereof, and equipped with the second circular inner peripheral surface (122*b*).

In the vane compressor (100, 100A) according to the present invention, the vane guide (120) is nestled between the pair of first comb-tooth parts (141, 142) of the vane (104), and there is accordingly no need to utilize centrifugal force to bring about reciprocating translation of the vane (104) and press them against the vane guide (120). Moreover, the center of gravity of the vane (104) is positioned close to the rotor rotation center (103), and the centrifugal force acting on the vane (104) is lower. Therefore, wear and sliding resistance between the vane (104) and the vane guide (120) can be significantly minimized.

Particularly in a case in which the vane guide (120) is a rotatably supported rotating vane guide, wear and sliding resistance between the vane (104) and the vane guide (120) can be reduced even more effectively.

Moreover, because the compression chambers (155, 156) are formed by the first comb-tooth part (141) of the vane (104) which is guided by the vane guide (120), the efficiency of utilization of space is high, and arrangement in multiple stages is easier.

Furthermore, in order to avoid disengagement of the first comb-tooth part (141) of the vane (104) from the first circular outer peripheral surface (120*a*), a width dimension (W) of an inside end surface of the first comb-tooth part (141) of the vane (104) abutting against the first circular outer peripheral surface (120*a*) of the vane guide (120) should be at least double the amount of eccentricity (Δ) between the rotor rotation center, and the center of the vane guide of the stator.

It is preferable that the stator (102) has an elastic member (176) that presses the vane guide (120) against the vane (104), along the direction of the center axis thereof. In so doing, appropriate positioning can be set in the axial direction for the vanes on the rotor side and the region on the stator side.

In the vane compressor (100A) according to the present invention, it is also possible to adopt a feature whereby the rotor (103) is equipped with a pair of the vane attachment grooves (137A, 137B) that intersect at a right angle at the center (103*a*) thereof, and the vane (104) is slidably attached in the respective vane attachment grooves.

Effect of the Invention

In the vane compressor according to the present invention, cylinders on the rotor side are eccentrically arranged in a ring-shaped space formed on the stator side, and the ring-shaped space is divided into an outer peripheral-side space and an inner peripheral-side space. Moreover, the vanes are slidably attached in the vane attachment grooves furnished on the rotor side, and in association with rotation of the rotor, the vanes experience reciprocating slide motion along the vane attachment grooves, while undergoing translation in the circumferential direction along the ring-shaped space on the stator side.

According to this feature, through concentric arrangement of the ring-shaped space on the stator side and the cylinders on the rotor side in multiple stages, is it easy for the compression chambers to be concentrically arranged in multiple stages. Thus, the compression chambers can easily be arranged in multiple stages with a small number of components, and therefore a vane compressor having a high compression ratio can be realized inexpensively. Moreover, through implementation of the present invention in a vacuum dry pump, there can be obtained an inexpensive dry vacuum pump with excellent base pressure.

MODE FOR CARRYING OUT THE INVENTION

The embodiments of a vane compressor in which the present invention is applied are described below with reference to the drawings.

(First Embodiment)

Figure 1:
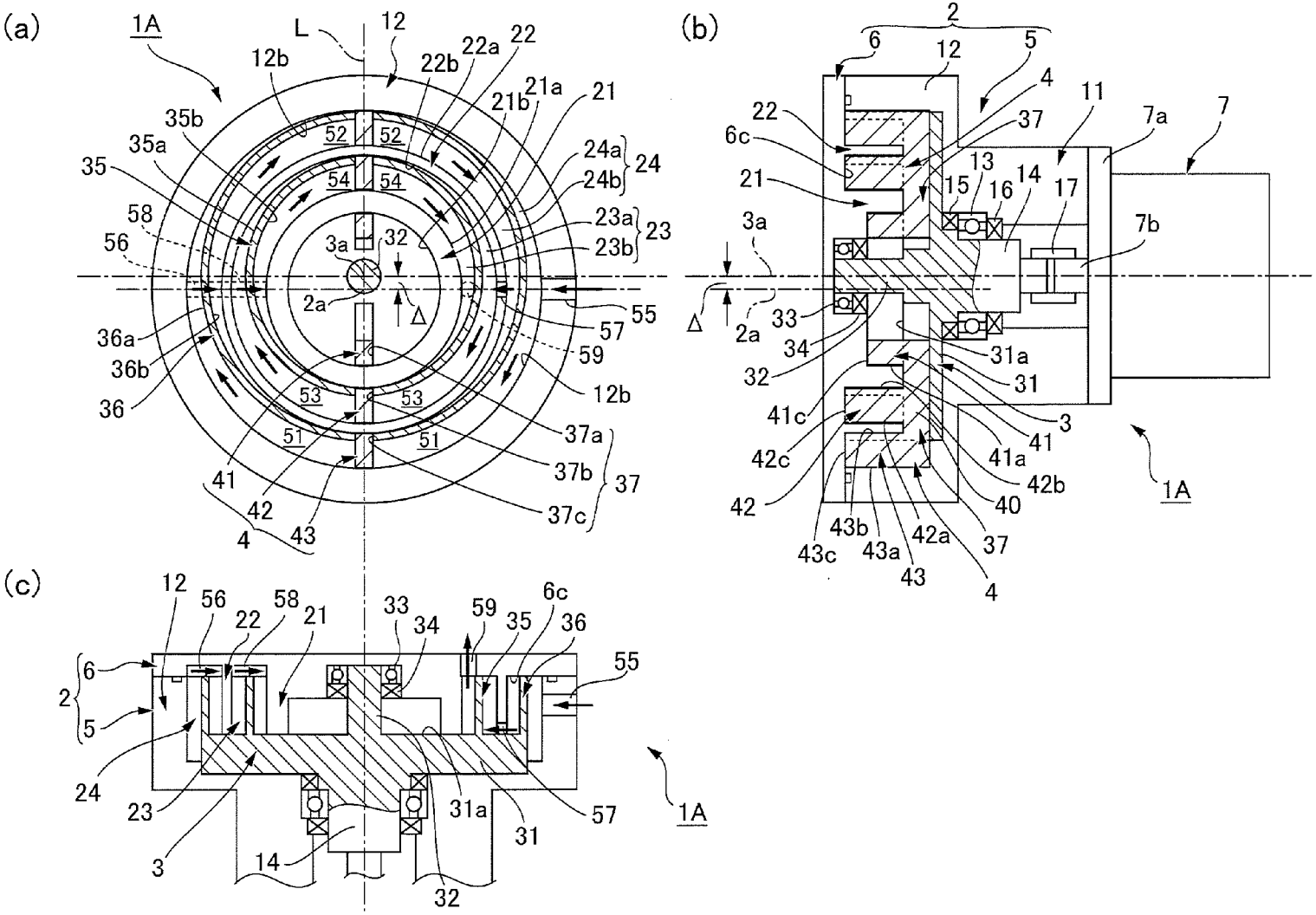
FIG. 1 (*a*) is a simplified internal configuration diagram showing a vane compressor according to a first embodiment of the present invention, (*b*) is a simplified cross sectional view thereof, and (*c*) is a simplified cross sectional view take in cross section orthogonal to the cross section of (*b*)

The description of the vane compressor according to a first embodiment makes reference to FIG. 1. The vane compressor 1A is equipped with a stator 2, a rotor 3 rotatably supported inside the stator 2, and a pair of vanes 4 that divide the space enclosed by the stator 2 and the rotor 3 into a plurality of compression chambers. The stator 2 is equipped with a holder 5 of cylindrical shape, and a stator plate 6 that closes off an opening at the front end side of the holder 5. The pair of vanes 4 are attached to the rotor 3 so as to be slidable in a radial direction thereof. In the present example, the pair of vanes 4 are arranged at an angular distance of 180 degrees, specifically, on a single straight line in a diametrical direction. A motor 7 is coaxially mounted on the back end surface of the holder 5, with rotation of the rotor 3 being driven by the motor 7.

The back side of the holder 5 serves as a small-diameter cylindrical part 11, and the front side serves as a large-diameter cylindrical part 12. Via a mounting flange 7*a*, the motor 7 is linked and fastened in a coaxial state to the back end surface of the small-diameter cylindrical part 11. Inside the small-diameter cylindrical part 11, a back side pivot shaft 14 of the rotor 3 is rotatably supported via a bearing 13. Seals 15, 16 are mounted to the front and back of the bearing 13, sealing off a zone between the back side pivot shaft 14 and the inner peripheral face of the cylindrical part 11 of the holder 5. The axial end portion at the back side of the back side pivot shaft 14 is linked and fastened in a coaxial state, via a shaft coupling 17, to the distal end portion of a motor rotating shaft 7*b* which is inserted from the back side.

The stator plate 6 is fastened in a coaxial state to the front end of the large-diameter cylindrical part 12 of the holder 5. The stator plate 6 is shaped like a disk having a contour shape identical to that of the cylindrical part 12, and a plurality of cylindrical parts (in the present example, a first cylindrical part 21 and a second cylindrical part 22) protrude concentrically from the inside end surface of the stator plate 6. Between the inside first cylindrical part 21 and the second cylindrical part 22 to the outside thereof, and between the second cylindrical part 22 and the outside cylindrical part 12 (third cylindrical part), there are respectively formed ring-shaped spaces 23, 24. The center 2*a* of the first cylindrical part 21, the second cylindrical part 22, and the cylindrical part 12 (the stator center) is eccentric by an unchanging amount of eccentricity Δ with respect to the rotor rotation center 3*a*. Consequently, the ring-shaped spaces 23, 24 are also eccentric by an identical amount with respect to the rotor rotation center 3*a*.

Next, the rotor 3 is equipped with a disk part 31, this disk part 31 facing the stator plate 6 with an unchanging distance therebetween, and the circular end surface 31*a* thereof being faced across a small gap by the distal end faces of the first and second cylindrical parts 21, 22 formed on the stator plate 6 side. On the disk part 31, the back side pivot shaft 14 is integrally formed on the back side thereof, and a front side pivot shaft 32 is integrally formed coaxially on the front side thereof. The axial distal end portion of the front side pivot shaft 32 is rotatably supported on the stator plate 6 side, via a bearing 33 mounted in a recessed portion formed on the inside end surface of the stator plate 6. A zone between the front side pivot shaft 32 and the stator plate 6 is sealed off by a seal 34.

On the circular end surface 31*a* of the disk part 31 of the rotor 3, there are integrally formed a plurality of concentric cylinders (in the present example, two cylinders 35, 36) which are centered on the rotor rotation center 3*a*. The inside cylinder 35 (first cylinder) projects into the inside ring-shaped space 23 on the stator 2 side, the ring-shaped distal end surface of this cylinder 35 facing the inside end surface 6*c* of the stator plate 6 across a small gap. Likewise, the outside cylinder 36 (second cylinder) projects into the outside ring-shaped space 24 on the stator 2 side, the ring-shaped distal end surface of this cylinder 36 facing the inside end surface 6*c* of the stator plate 6 across a small gap. The inside ring-shaped space 23 is thereby divided by the cylinder 35 into an inner peripheral-side space 23*b* and an outer peripheral-side space 23*a*, while the outside ring-shaped space 24 is divided by the cylinder 36 into an inner peripheral-side space 24*b* and an outer peripheral-side space 24*a*.

The cylinders 35, 36 on the rotor side are respectively inserted in a state of eccentricity, by an amount of eccentricity Δ, with respect to the ring-shaped spaces 23, 24 on the stator side. In the present example, as shown in FIG. 1 (*a*), circular outer peripheral surfaces 35*a*, 36*a* of the cylinders 35, 36, at a first end thereof in a single diametrical direction L, face the inner peripheral surface 22*b* of the cylindrical part 22 and the inner peripheral surface 12*b* of the cylindrical part 12 across small gaps, and at the end on the opposite side in the diametrical direction L, face the inner peripheral surfaces 22*b*, 12*b* of the cylindrical parts 22, 12 across maximum gaps. Consequently, the outer peripheral-side space 23*a* of the inside ring-shaped space 23 progressively increases in width along the circumferential direction going from the first end in the diametrical direction L towards the end on the opposite side; and, conversely, progressively decreases in width going from that end towards the other end. The width of the inner peripheral-side space 23*b* changes in the opposite manner along the circumferential direction. The width of the outer peripheral-side space 24*a* of the outside ring-shaped space 24 changes analogously to that of the outer peripheral-side space 23*a*, and the width of the inner peripheral-side space 24*b* changes analogously to that of the inner peripheral-side space 23*b*.

Next, a pair of vane attachment grooves 37 extending in a radial direction are formed on the rotor 3. The vanes 4 are attached in these vane attachment grooves 37, in a slidable state along the vane attachment grooves 37. Each of the vane attachment grooves 37 is a groove of unchanging width extending outwardly in a straight line in a radial direction from a position in proximity to the rotor rotation center 3*a*, and is equipped with a groove part 37*a* of unchanging depth formed on the circular end surface 31*a* of the disk part 31 of the rotor 3, and slit parts 37*b*, 37*c* that pass in a radial direction through parts of the cylinders 35, 36 that face the groove part 37*a*.

The vanes 4 which have been slidably attached in the vane attachment grooves 37 are equipped with a linking plate part 40 of unchanging width attached in the groove part 37*a* of the disk part 31, and a plurality of comb-tooth parts (in the present example, three comb-tooth parts 41, 42, 43) that protrude at unchanging distance from this linking plate part 40.

The comb-tooth parts 41 positioned to the rotor rotation center 3*a* side (the first comb-tooth parts) are positioned to the inner peripheral side of the inside cylindrical part 21, with the distal end surfaces 41*c* thereof facing the inside end surface 6*c* on the stator plate 6 side across a small gap (non-contacting state), and with the outer peripheral-side end surfaces 41*a* thereof able to contact the inner peripheral surface 21*b* of the cylindrical part 21. When the rotor 3 rotates, the vanes 4 are pushed outwardly due to centrifugal force, and slide outwardly along the vane attachment grooves 37. As a result, the outer peripheral-side end surfaces 41*a* of the first comb-tooth parts 41 of the vane 4 are pressed against the inner peripheral surface 21*b* of the cylindrical part 21, whereby the vanes 4 slide along the peripheral surface 21*b* in association with rotation of the rotor 3. Stated another way, the peripheral surface 21*b* of the cylindrical part 21 functions as a vane guide surface, controlling the reciprocating slide motion of the vanes 4 in association with rotation of the rotor 3.

In contrast to this, the comb-tooth parts 42 (the second comb-tooth parts) are positioned within the slit parts 37*b* of the inside cylinder 35 and the inside ring-shaped space 23, with the distal end surfaces 42*c* thereof facing the inside end surface 6*c* on the stator plate 6 side across a small gap (non-contacting state). In a state in which the comb-tooth parts 41 (the first comb-tooth parts) are abutting against the inner peripheral surface 21*b* of the cylindrical part 21, the outer peripheral-side end surfaces 42*a* of the comb-tooth parts 42 face the inner peripheral surface 22*b* of the cylindrical part 22 across small gaps (non-contacting state), while the inner peripheral-side end surfaces 42*b* thereof confronts the outer peripheral surface 21*a* of the cylindrical part 21 across small gaps (non-contacting state).

Likewise, the comb-tooth parts 43 positioned furthest to the outside are positioned within the slit parts 37*c* of the outside cylinder 36 and the outside ring-shaped space 24, with the distal end surface 43*c* thereof facing the inside end surface 6*c* on the stator plate 6 side across a small gap (non-contacting state). Moreover, in a state in which the comb-tooth parts 41 are abutting against the inner peripheral surface 21*b* of the cylindrical part 21, the outer peripheral-side end surfaces 43*a* of the comb-tooth parts 43 face the inner peripheral surface 12*b* of the cylindrical part 12 across small gaps (non-contacting state), while the inner peripheral-side end surfaces 43*b* thereof confronts the outer peripheral surface 22*a* of the cylindrical part 22 across small gaps (non-contacting state).

Here, in order to bring about rotation of the comb-tooth parts 42, 43 along the outer peripheral surfaces and inner peripheral surfaces of the cylindrical parts 21, 22, 12 while maintaining unchanging small distances, in the present example, the shapes of the inner peripheral surfaces and outer peripheral surfaces of the cylindrical parts 21, 22, and of the inner peripheral surface of the cylindrical part 12, are defined as follows. Specifically, the contour shape of the inner peripheral surface 21*b* of the cylindrical part 21 is defined by the rotation trajectory of the outer peripheral-side end surfaces 41*a* of the comb-tooth parts 41 of the vanes 4 in confrontation thereto, or by an approximate curve of the rotation trajectory. The contour shapes of the outer peripheral surface 21*a* of the cylindrical part 21 and the inner peripheral surface 22*b* of the cylindrical part 22 are defined by the rotation trajectories of the inner peripheral-side end surfaces 42*b* and the outer peripheral-side end surfaces 42*a* of the comb-tooth parts 42 of the vanes 4 in confrontation thereto, or by approximate curves of these rotation trajectories. Likewise, the contour shapes of the outer peripheral surface 22*a* of the cylindrical part 22 and the inner peripheral surface 12*b* of the cylindrical part 12 are defined by the rotation trajectories of the inner peripheral-side end surfaces 43*b* and the outer peripheral-side end surfaces 43*a* of the comb-tooth parts 43 in confrontation thereto, or by approximate curves of these rotation trajectories.

In the aforedescribed manner, the outer peripheral-side spaces 23*a*, 24*a* and the inner peripheral-side spaces 23*b*, 24*b* of the ring-shaped spaces 23, 24 are respectively divided into two compression chambers by the comb-tooth parts 42, 43 of the vanes 4. Specifically, as shown in FIG. 1 (*a*), the outer peripheral-side space 24*a* of the ring-shaped space 24 is divided into two first-stage compression chambers 51, and the inner peripheral-side space 24*b* of the ring-shaped space 24 is divided into two second-stage compression chambers 52, by the comb-tooth parts 43. Moreover, the outer peripheral-side space 23*a* of the inside ring-shaped space 23 is divided into two third-stage compression chambers 53 by the comb-tooth parts 42, and the inner peripheral-side space 23*b* is divided into two fourth-stage compression chambers 54 by the comb-tooth parts 42.

In a region of the cylindrical part 12 within a range of rotation angles in which the volume of the first-stage compression chambers 51 progressively increases in association with the rotation of the rotor 3 (in the present example, in a region at an angular position rotated by 90 degrees with respect to the diametrical direction L), there is formed an intake port 55 for intake of fluid from the outside. In a region of the inside end surface 6*c* of the stator plate 6 within a range of rotation angles in which the volume of the first-stage compression chambers 51 progressively decreases in association with the rotation of the rotor 3 (in the present example, in a region rotated by 180 degrees with respect to the intake port 55), there is formed a communication port 56 communicating between the first-stage compression chambers 51 and the second-stage compression chambers 52. Likewise, in the stator plate 6, there are formed a communication port 57 for the second-stage compression chambers 52 and the third-stage compression chambers 53, and a communication port 58 for the third-stage compression chambers 53 and the fourth-stage compression chambers 54. Furthermore, a discharge port 59 for discharging the compressed fluid from the fourth-stage compression chambers 54 of the final stage is formed in the stator plate 6.

Figure 2:
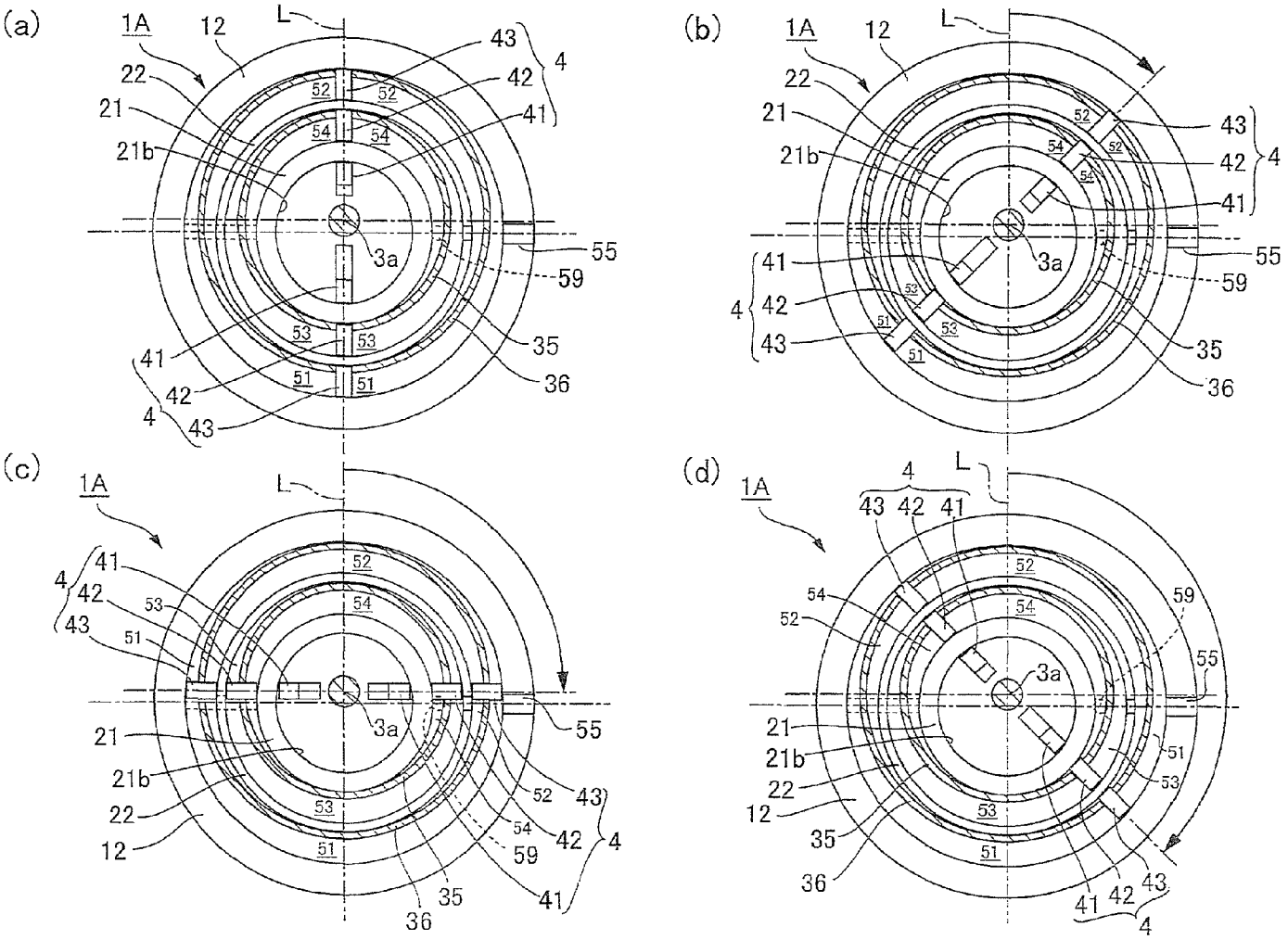
FIGS. 2 (*a*) to 2 (*d*) are a descriptive diagram showing movement of the vane compressor of FIG. 1.

The description of movement of the vane compressor 1A will be made with reference to FIG. 2. When the rotor 3 is rotated by the motor 7, the pair of vanes 4 rotate about the rotor rotation center 3*a*, in unison with the rotor 3. By virtue of being slidable in a radial direction with respect to the rotor 3, the vanes 4 rotate while being pushed outwardly in a radial direction by the centrifugal force generated by rotation. Specifically, the comb-tooth parts 41 furthest towards the center side of the vane 4 slide along the inner peripheral surface 21*b* of the cylinder part 21 furthest towards the inside. Each time that the vanes 4 rotate, the first stage compression chambers 51 through fourth stage compression chambers 54 which are divided by the comb-tooth parts 42, 43 of the vanes 4 repeat a fluid intake stroke in association with increasing volume, and a fluid compression/discharge stroke in association with decreasing volume, the compressed fluid being delivered to the compression chambers of the next stage. The compressed fluid from the fourth-stage compression chambers 54 of the final stage is discharged from the discharge port 59.

In the vane compressor 1A of the present example, volume compression chambers can be furnished concentrically in multiple stages by increasing the number of the cylindrical parts 21, 22 of the stator 2, the number of cylinders 35, 36 of the rotor 3, and the number of comb-tooth parts 42, 43 (second comb-tooth parts) of the vanes 4. Consequently, a vane compressor having high compression capability can be manufactured inexpensively in a simple structure, with a minimum number of components. Moreover, because the compression chambers of each stage are arrayed concentrically, the communication paths communicating between them can be formed in a simple manner. Consequently, the vane compressor 1A can be employed as an inexpensive dry vacuum pump with excellent base pressure, or the like.

Moreover, as the vanes 4 are being pushed outwardly in a radial direction by centrifugal force, only the comb-tooth parts 41 on the center side, which have the slowest peripheral speed, slide along the inner peripheral face 21*b* of the cylindrical part 21 on the stationary side. Other parts rotate in a non-contacting state. Consequently, wear occurring between the vanes 4 and regions of the cylindrical part 12 against which they slide can be reduced, so the life of these components can be extended. Moreover, because the sliding resistance of the vanes 4 can be reduced, the loss power of the vane compressor 1A can be reduced.

Furthermore, the outer peripheral surface shape of the cylindrical part 21, the inner and outer peripheral surface shapes of the cylindrical part 22, and the inner peripheral surface shape of the cylindrical part 12 are defined employing the rotation trajectories of those regions of the comb-tooth parts 41 to 43 of the vanes 4 that face these parts, or approximate curves of these rotation trajectories. In so doing, the comb-tooth parts 42, 43 and the cylindrical parts 21, 22, 12 can be maintained in confrontation in a non-contacting state, with an optimal unchanging small gap therebetween. In the present example, one pair of vanes 4 are equipped, but the number of vanes may be three or more.

(Second Embodiment)

Figure 3:
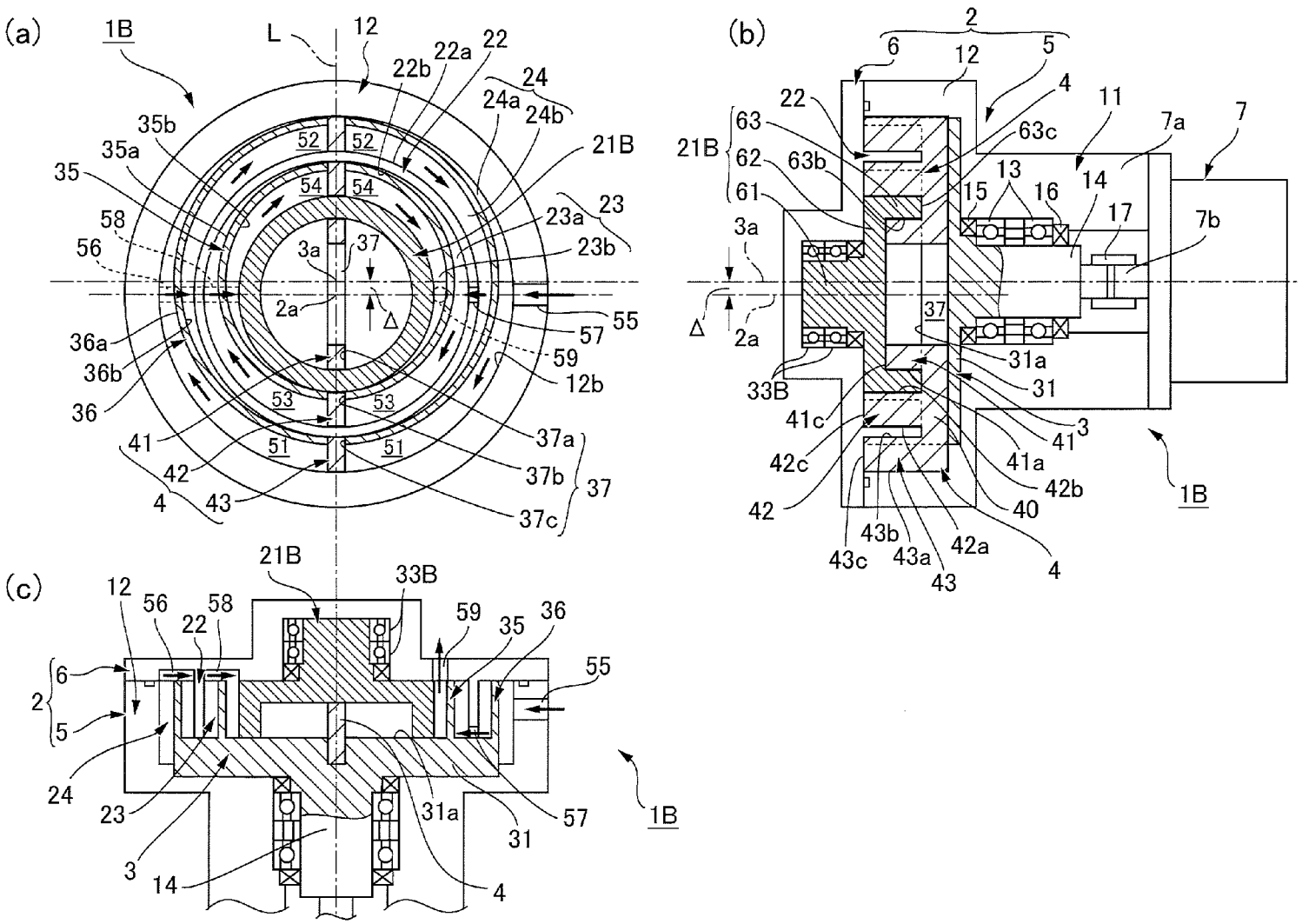
FIG. 3 (*a*) is a simplified internal configuration diagram showing a vane compressor according to a second embodiment of the present invention, (*b*) is a simplified cross sectional view thereof, and (*c*) is a simplified cross sectional view take in cross section orthogonal to the cross section of (*b*)

A vane compressor according to a second embodiment will be described with reference to FIG. 3. The basic structure of the vane compressor 1B is the same as that of the vane compressor 1A according to the first embodiment; therefore corresponding parts have been assigned the same symbols, omitting description of these parts.

In place of the cylindrical part 21 positioned furthest to the inside on the stator side in the vane compressor 1A, the vane compressor 1B is equipped with a vane guide 21B rotatably mounted on the stator plate 6 side. The vane guide 21B is equipped with a pivot shaft part 61 that is rotatably supported, via a bearing 33B, in a recessed portion formed in the center part of the stator plate 6; a disk part 62 integrally formed at an end of this pivot shaft part 61; and a cylindrical part 63 integrally formed in the outer peripheral edge part of the end surface of the disk part 62. The distal end 63*c* of the cylindrical part 63 confronts a circular end surface 31*a* of the rotor 3 across a small gap.

The inner peripheral surface 63*b* of the cylindrical part 63 functions as a guide surface for the vanes 4. Specifically, due to centrifugal force arising in association with rotation of the rotor 3, the outer peripheral-side end surfaces 41*a* of the comb-tooth parts 41 (the first comb-tooth parts) of the vanes 4 slide against the inner peripheral surface 63*b* while being pressed thereagainst, controlling the reciprocating slide motion of the vanes 4.

The vane guide 21B is rotatably supported on the stator plate 6 side. Consequently, due to the vanes 4 rotating in association with rotation of the rotor 3, the vane guide 21B turns in tandem therewith. Because the rotor rotation center 3*a* (which is the center of rotation of the vanes 4) and the stator center 2*a* (which is the center of the vane guide 21B) are offset by the amount of eccentricity Δ, slip is generated between the two members to a corresponding extent; however, the slip rate between the two members can be significantly reduced, as compared with the case in which the vane guide 21B does not turn in tandem. Therefore, wear between these members can be significantly reduced, and slide resistance between these members can be significantly reduced as well.

In the vane compressor 1B of the present example, the rotor 3 is supported in cantilever fashion by the holder 5, and the disk part 31 of the rotor 3 is not equipped with the front side pivot shaft 32 in the vane compressor 1A of the first embodiment. Consequently, the groove parts 37*a* of the pair of vane attachment grooves 37 formed in the disk part 31 are formed as a single continuous groove.

(Third Embodiment)

A vane compressor according to a third embodiment of the present invention is described with reference to FIG. 4. The vane compressor 100 is equipped with a stator 102, a rotor 103 rotatably supported inside the stator 102, and a vane 104 (an integral type vane) that divides the space enclosed by the stator 102 and the rotor 103 into a plurality of compression chambers. The stator 102 is equipped with a holder 105 of cylindrical shape, and a stator plate 106 that closes off an opening at the front end side of the holder 105. The vane 104 is attached to the rotor 103 so as to be slidable in a diametrical direction thereof. A motor 107 is coaxially mounted on the back end surface of the holder 105, with rotation of the rotor 103 being driven by the motor 107.

The back side of the holder 105 serves as a small-diameter cylindrical part 111, and the front side serves as a large-diameter cylindrical part 112. Via a mounting flange 107*a*, the motor 107 is linked and fastened in a coaxial state to the back end surface of the small-diameter cylindrical part 111. Inside the small-diameter cylindrical part 111, a back side pivot shaft 114 of the rotor 103 is rotatably supported via a pair of bearings 113. Seals 115, 116 are mounted to the front and back of the bearings 113, sealing off a zone between the back side pivot shaft 114 and the inner peripheral face of the cylindrical part 111 of the holder 105. The axial end portion at the back side of the back side pivot shaft 114 is linked and fastened in a coaxial state, via a shaft coupling 117, to the distal end portion of a motor rotating shaft 107*b* which is inserted from the back side.

The stator plate 106 is fastened coaxially to the front end of the large-diameter cylindrical part 112 of the holder 105. The stator plate 106 is shaped like a disk having a contour shape identical to that of the cylindrical part 112, and in the center portion of the inside end surface 106*c* of the stator plate 106, a vane guide 120 of cylindrical shape for bringing about reciprocating slide motion of the vane 104 in a diametrical direction in association with rotation of the rotor 103 is mounted concentrically to the stator center 102*a*. Moreover, on the inside end surface 106*c* there are formed a plurality of cylindrical parts (in the present example, a first cylindrical part 121 and a second cylindrical part 122) that concentrically encircle the vane guide 120. Between the vane guide 120 and the inside first cylindrical part 121, between the first cylindrical part 121 and the outside second cylindrical part 122, and between the second cylindrical part 122 and the outside cylindrical part 112, there are respectively formed ring-shaped spaces 123, 124, 125.

The stator center 102*a* is eccentric by an amount of eccentricity Δ with respect to the rotor rotation center 103*a*. Consequently, the ring-shaped spaces 123, 124, 125 are also eccentric by an unchanging amount of eccentricity Δ with respect to the rotor rotation center 103*a*.

Figure 4:
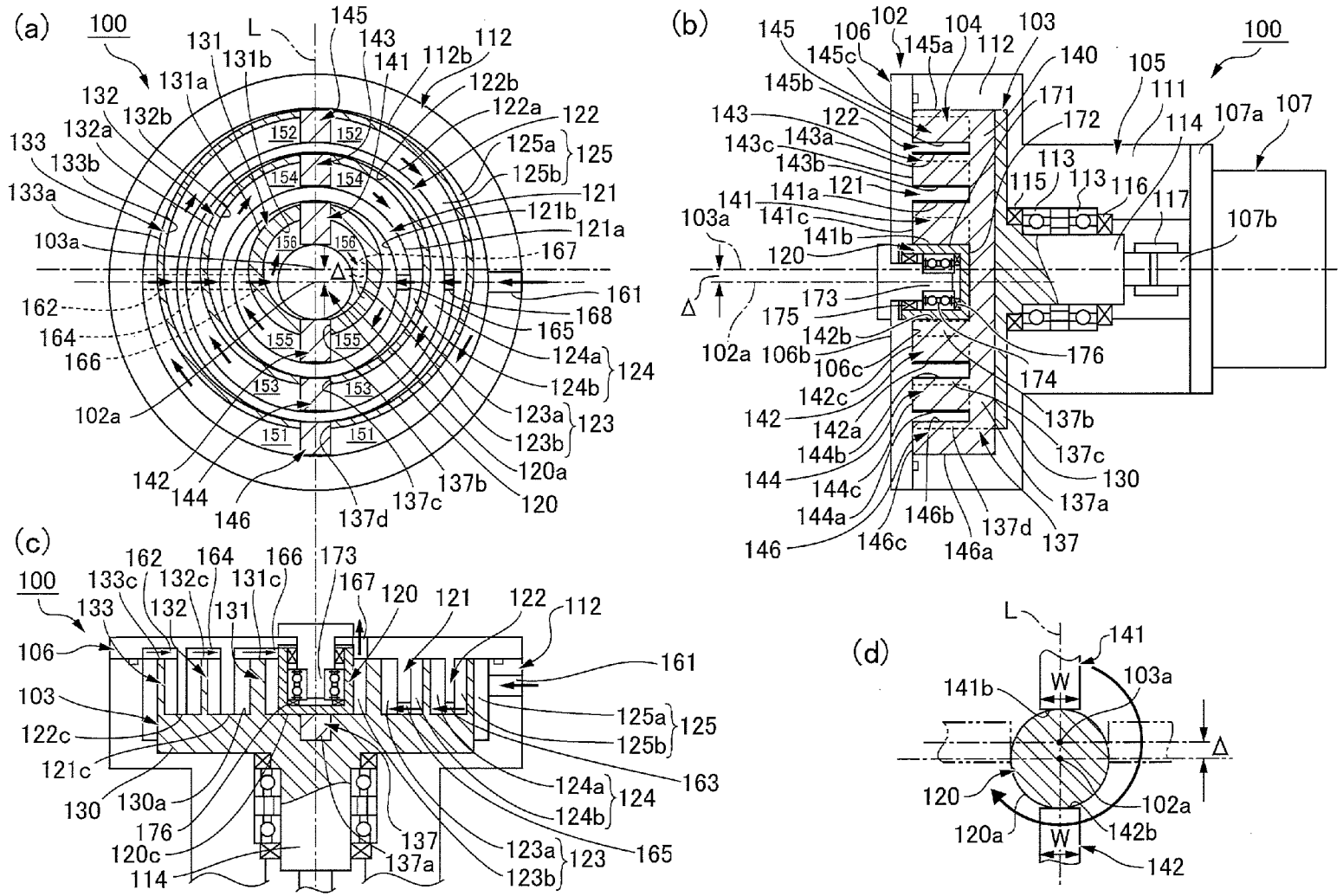
FIG. 4 (*a*) is a simplified internal configuration diagram showing a vane compressor according to a third embodiment of the present invention, (*b*) is a simplified cross sectional view thereof, (*c*) is a simplified cross sectional view take in cross section orthogonal to the cross section of (*b*), and (*d*) is a descriptive diagram showing the width dimension of the vanes.

Next, as shown in FIG. 4 (*c*), the rotor 103 is equipped with a disk part 130, this disk part 130 facing the stator plate 106 with an unchanging distance therebetween. The circular end surface 130*a* of the disk part 130 is abutted by the end surface 120*c* of the vane guide 120 which is mounted on the stator plate 106 side, as well as being confronted across a small gap by the distal end faces 121*c*, 122*c* of the first and second cylindrical parts 121, 122. The back side pivot shaft 114 is integrally formed on the back side of the disk part 130.

On the circular end surface 130*a* of the disk part 130 of the rotor 103, there are integrally formed a plurality of concentric cylinders (in the present example, three cylinders 131, 132, 133) which are centered on the rotor rotation center 103*a*. The inside cylinder 131 projects into the inside ring-shaped space 123 on the stator 102 side, with the distal end surface thereof facing the end surface 106*c* of the stator plate 106 across a small gap. Likewise, the outside cylinders 132, 133 respectively project into the outside ring-shaped spaces 124, 125 on the stator 102 side, with the distal end surfaces thereof facing the inside end surface 106*c* of the stator plate 106 across a small gap. The ring-shaped spaces 123 to 125 are thereby respectively divided by the cylinders 131 to 133 into inner peripheral-side spaces 123*b*, 124*b*, 125*b*, and outer peripheral-side spaces 123*a*, 124*a*, 125*a*.

As shown in FIG. 4 (*a*), circular outer peripheral surfaces 131*a* to 133*a* of the cylinders 131 to 133, at a first end thereof in a single diametrical direction L, face the inner peripheral surfaces 121*b*, 122*b*, 112*b* of the cylindrical parts 121, 122, 112 across small gaps; and at the end on the opposite side in the diametrical direction L, face the inner peripheral surfaces 121*b*, 122*b*, 112*b* of the cylindrical parts 121, 122, 112 across maximum gaps. Consequently, the outer peripheral-side space 123*a* of the inside ring-shaped space 123 progressively increases in width along the circumferential direction going from the first end in the diametrical direction L towards the end on the opposite side; and, conversely, progressively decreases in width going from that other end towards the first end. The width of the inner peripheral-side space 123*b* changes in the opposite manner along the circumferential direction. The outer peripheral-side spaces 124*a*, 125*a* of the inside ring-shaped spaces 124, 125 change in width in comparable fashion to the outer peripheral-side space 123*a*, and the inner peripheral-side spaces 124*b*, 125*b* change in width in comparable fashion to the inner peripheral-side space 123*b*.

Next, a vane attachment groove 137 is formed extending in a diametrical direction in the rotor 103. The vane 104 is attached in this vane attachment groove 137, in a slidable state along the vane attachment groove 137. The vane attachment groove 137 is a groove of unchanging width extending in a straight line in a diametrical direction through the rotor rotation center 103*a*; and is equipped with a groove part 137*a* of unchanging depth formed on the circular end surface 130*a* of the disk part 130 of the rotor 103, and with slit parts 137*b*, 137*c*, 137*d* that pass in a radial direction through parts of the cylinders 131 to 133 that face the groove part 137*a*.

The vane 104 which has been slidably attached in the vane attachment groove 137 is equipped with a linking plate part 140 of unchanging width attached in the groove part 137*a* of the disk part 130, and a plurality of comb-tooth parts (in the present example, six comb-tooth parts 141 to 146) that protrude at unchanging distance from this linking plate part 140. These comb-tooth parts 141 to 146 are formed point-symmetrically to either side of the rotor rotation center 103*a*.

The pair of comb-tooth parts 141, 142 positioned to the rotor rotation center 103*a* side are positioned within the inside ring-shaped space 123, with the distal end surfaces 141*c* thereof facing the inside end surface 106*c* on the stator plate 106 side across a small gap (non-contacting state), and with the inner peripheral-side end surfaces 141*b* thereof contacting the outer peripheral surface 120*a* of the vane guide 120. When the rotor 103 rotates, because the vane guide 120 is sandwiched between the comb-tooth parts 141, 142 of the vane 104 which rotates in unison therewith, the vane 104 is guided by the outer peripheral surface 120*a* of the vane guide 120, and rotates while undergoing reciprocating slide motion in a rotor diametrical direction along the vane attachment groove 137. In contrast to this, the outer peripheral-side end surface 141*a* of the comb-tooth part 141 rotates while facing the inner peripheral surface 121*b* of the cylindrical part 121 across a small gap (non-contacting state).

The outside pair of comb-tooth parts 143, 144 are positioned within the ring-shaped space 124, with the distal end surfaces 143*c*, 144*c* thereof facing the inside end surface 106*c* on the stator plate 106 side across a small gap (non-contacting state). Moreover, of these comb-tooth parts 143, 144, the inner peripheral-side end surfaces 143*b*, 144*b* thereof face the outer peripheral surface 121*a* of the cylindrical part 121 across a small gap (non-contacting state), while the outer peripheral-side end surfaces 143*a*, 144*a* thereof face the inner peripheral surface 122*b* of the cylindrical part 122 across a small gap (non-contacting state). Likewise, the pair of comb-tooth parts 145, 146 positioned furthest to the outside are positioned within the ring-shaped space 125, with the distal end surfaces 145*a*, 146*c* thereof facing the inside end surface 106*c* on the stator plate 106 side across a small gap (non-contacting state). Moreover, of these comb-tooth parts 145, 146, the inner peripheral-side end surfaces 145*b*, 146*b* thereof face the outer peripheral surface 122*a* of the cylindrical part 122 across a small gap, while the outer peripheral-side end surfaces 145*a*, 146*a* thereof face the inner peripheral surface 112*b* of the cylindrical part 112 across a small gap.

Here, in order to bring about rotation of the comb-tooth parts 141 to 146 while maintaining an unchanging small distance with respect to the cylindrical parts 121, 122, 112 in the aforedescribed manner, in the present example, the shape of the outer peripheral surface 120*a* of the vane guide 120, the shapes of the inner peripheral surfaces and outer peripheral surfaces of the cylindrical parts 121, 122, and the shape of the inner peripheral surface of the cylindrical part 112, are defined as follows. Specifically, the contour shape of the outer peripheral surface 120*a* of the vane guide 120 is defined by the rotation trajectory of the inner peripheral-side end surfaces 141*b*, 142*b* of the comb-tooth parts 141, 142 of the vane 104 in confrontation thereto, or by an approximate curve of the rotation trajectory. Likewise, the contour shapes of the inner peripheral surfaces 121*b*, 122*b* and the outer peripheral surface shapes 121*a*, 122*a* of the cylindrical parts 121, 122, and of the inner peripheral surface 112*b* of the cylindrical part 112, are defined by the rotation trajectories of the regions of the comb-tooth parts of the vane 4 in confrontation thereto, or by approximate curves of these rotation trajectories.

In the aforedescribed manner, the outer peripheral-side spaces 123*a*, 124*a*, 125*a* and the inner peripheral-side spaces 123*b*, 124*b*, 125*b* of the ring-shaped spaces 123, 124, 125 are respectively divided into two compression chambers by the comb-tooth parts 141 to 146 of the vane 104. Specifically, as shown in FIG. 4 (*a*), the outer peripheral-side space 125*a* of the ring-shaped space 125 is divided into two first-stage compression chambers 151 by the comb-tooth parts 146, 145, and the inner peripheral-side space 125*b* thereof is divided into two second-stage compression chambers 152 by the comb-tooth parts 146, 145. Moreover, the outer peripheral-side space 124*a* of the ring-shaped space 124 is divided into two third-stage compression chambers 153 by the comb-tooth parts 144, 143, and the inner peripheral-side space 124*b* is divided into two fourth-stage compression chambers 154 by the comb-tooth parts 144, 143. Further, the outer peripheral-side space 123*a* of the ring-shaped space 123 is divided into two fifth-stage compression chambers 155 by the comb-tooth parts 142, 141, and the inner peripheral-side space 123*b* thereof is divided into two sixth-stage compression chambers 156 by the comb-tooth parts 142, 141.

In a region of the cylindrical part 112 within the rotation angle range in which the volume of the first-stage compression chambers 151 progressively increases in association with the rotation of the rotor 103 (in the present example, in a region at an angular position rotated by 90 degrees with respect to the diametrical direction L), there is formed an intake port 161 for intake of fluid from the outside. In a region of the inside end surface 106*c* of the stator plate 106 within a range of rotation angles in which the volume of the first-stage compression chambers 151 progressively decreases in association with the rotation of the rotor 103 (in the present example, in a region rotated by 180 degrees with respect to the intake port 161), there is formed a communication port 162 communicating between the first-stage compression chambers 151 and the second-stage compression chambers 152. Likewise, in the stator plate 106, there are formed a communication port 163 for the second-stage compression chambers 152 and the third-stage compression chambers 153, a communication port 164 for the third-stage compression chambers 153 and the fourth-stage compression chambers 154, a communication port 165 for the fourth-stage compression chambers 154 and the fifth-stage compression chambers 155, and a communication port 166 for the fifth-stage compression chambers 155 and the sixth-stage compression chambers 156. Furthermore, a discharge port 167 for discharging the compressed fluid from the sixth-stage compression chambers 156 of the final stage is formed in the stator plate 106.

The vane guide 120 of the present example is rotatably mounted onto the center portion of the stator plate 106. The vane guide 120 is equipped with a cylindrical part 171, and an integrally formed disk part 172 that closes off the end at the rotor side of this cylindrical part 171, the end surface 120*c* of the disk part 172 contacting the circular end surface 130*a* of the disk part 130 of the rotor 103. A shaft member 173, which has been attached from the side situated towards the outside end surface 106*b* of the stator plate 106, is inserted coaxially into the interior of the cylindrical part 171. The cylindrical part 171 is rotatably supported by the shaft member 173 via a bearing 174. The zone between the shaft member 173 and the cylindrical part 171 is sealed by a seal 175.

Furthermore, a wave washer 176 (elastic member) is inserted between the end surface of the bearing 174 and the inside end surface of the disk part 172 of the vane guide 120. The vane guide 120 is pressed against the circular end surface 130*a* of the disk part 130 of the rotor 103 by this wave washer 176. Consequently, the linking plate part 140 of the vane 104, which has been installed in the groove part 137*a* of the vane attachment groove 137 extending in a diametrical direction across the circular end surface 130*a*, is pressed into the groove part 137*a* by the vane guide 120. In this way, the rotor 103 and the vane 104 are pressed in the direction of the rotor center axis with respect to the holder 5, defining the positions thereof in the direction of the rotor center axis. Therefore, the end surface 106*c* of the stator plate 106 and the distal end surfaces 131*c* to 133*c* of the cylinders 131 to 133 on the rotor side can be retained in a non-contacting state, with small gaps therebetween. Moreover, the circular end surface 130*a* of the disk part 130 on the rotor side and the distal end surfaces 121*c*, 122*c* of the cylindrical parts 121, 122 on the stator side can be retained in a non-contacting state, with small gaps therebetween.

In order to avoid disengagement of the comb-tooth parts 141, 142 of the vane 104 from outer peripheral surface 120*a* during rotation, the width dimension W of the inner peripheral-side end surfaces that in the first comb-tooth parts 141, 142 of the vane 104 abut against the outer peripheral surface 120*a* of the vane guide 120 should be at least double the amount of eccentricity Δ between the rotor rotation center 103*a* and the stator center 102*a*, as shown in FIG. 4 (*d*).

Figure 5:
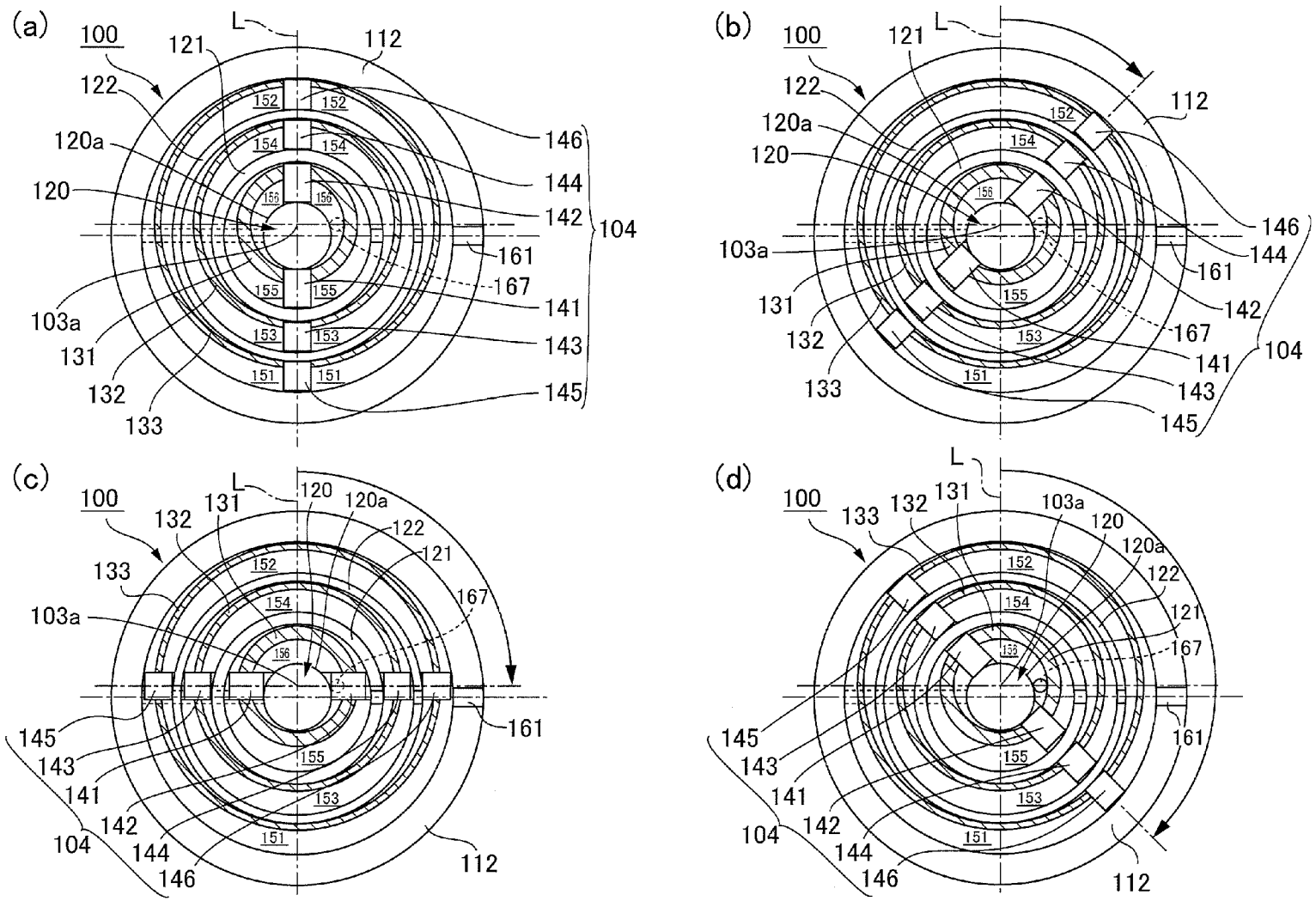
FIGS. 5 (*a*) to 5 (*d*) are a descriptive diagram showing movement of the vane compressor of FIG. 4.

The following description of movement of the vane compressor 100 makes reference to FIG. 5. When the rotor 103 is rotated by the motor 107, the vane 104 rotates about the rotor rotation center 103*a* in unison with the rotor 103. The vane 104 is slidable in a diametrical direction with respect to the rotor 103, and rotates while undergoing reciprocating slide motion in a diametrical direction, guided by the outer peripheral surface 120*a* of the vane guide 120 which is positioned at the rotor rotation center 103*a*. As a result, the compression chambers 151 to 156 of the first to sixth stages, while in a state of being substantially sealed off by the comb-tooth parts 141 to 146 of the vane 104, rotate together with the rotor 103, with the volume thereof repeatedly increasing and decreasing each time that that rotor 103 rotates by 180 degrees. The fluid is thereby compressed in succession within the compression chambers 151 to 156, and compressed fluid which has been compressed to a high compression ratio is then discharged from the compression chamber 156 of the final stage.

In the vane compressor 100 of the present example, volume compression chambers can be furnished concentrically in multiple stages by increasing the number of cylindrical parts on the stator side, the number of cylinders on the rotor side, and the number of comb-tooth parts of the vane. Consequently, a vane compressor having high compression capability can be manufactured inexpensively in a simple structure, with a minimum number of components. Moreover, because the compression chambers of each stage are arrayed concentrically, the communication paths communicating between them can be formed in a simple manner. Consequently, the vane compressor 100 can be employed as an inexpensive dry vacuum pump with excellent base pressure, or the like.

Moreover, because the vane guide 120 is sandwiched between the pair of comb-tooth parts 141, 142 of the vane 104, there is no need, utilizing centrifugal force, to bring about reciprocating translation of the vane 104 and press it against the inner peripheral surface of the vane guide 120. Moreover, the center of gravity of the vane 104 is positioned close to the rotation center of the rotor, and the centrifugal force acting on the vane 104 is lower. Therefore, wear and sliding resistance between the vane 104 and the vane guide 120 can be significantly minimized. In particular, in the present example, because the vane guide 120 is rotatably supported on the stator side, wear and sliding resistance between the vane and the vane guide can be reduced even more effectively.

Moreover, because the final-stage compression chamber 156 is formed by the comb-tooth parts 141, 142 of the vane 104 which is guided by the vane guide 120, the efficiency of utilization of space is high, and arrangement in multiple stages is easy.

Furthermore, the rotor 103 and the vane guide 120 are pressed by the wave washer 176 along the direction of the center axis thereof, towards the side where the holder 105 of the stator 102 is situated. Consequently, the positions of the rotor 103 and the vane 104 with respect to the stator 102 in the center axis direction are defined, and the relative positions thereof in the axial direction can be set accurately.

(Fourth Embodiment)

Figure 6:
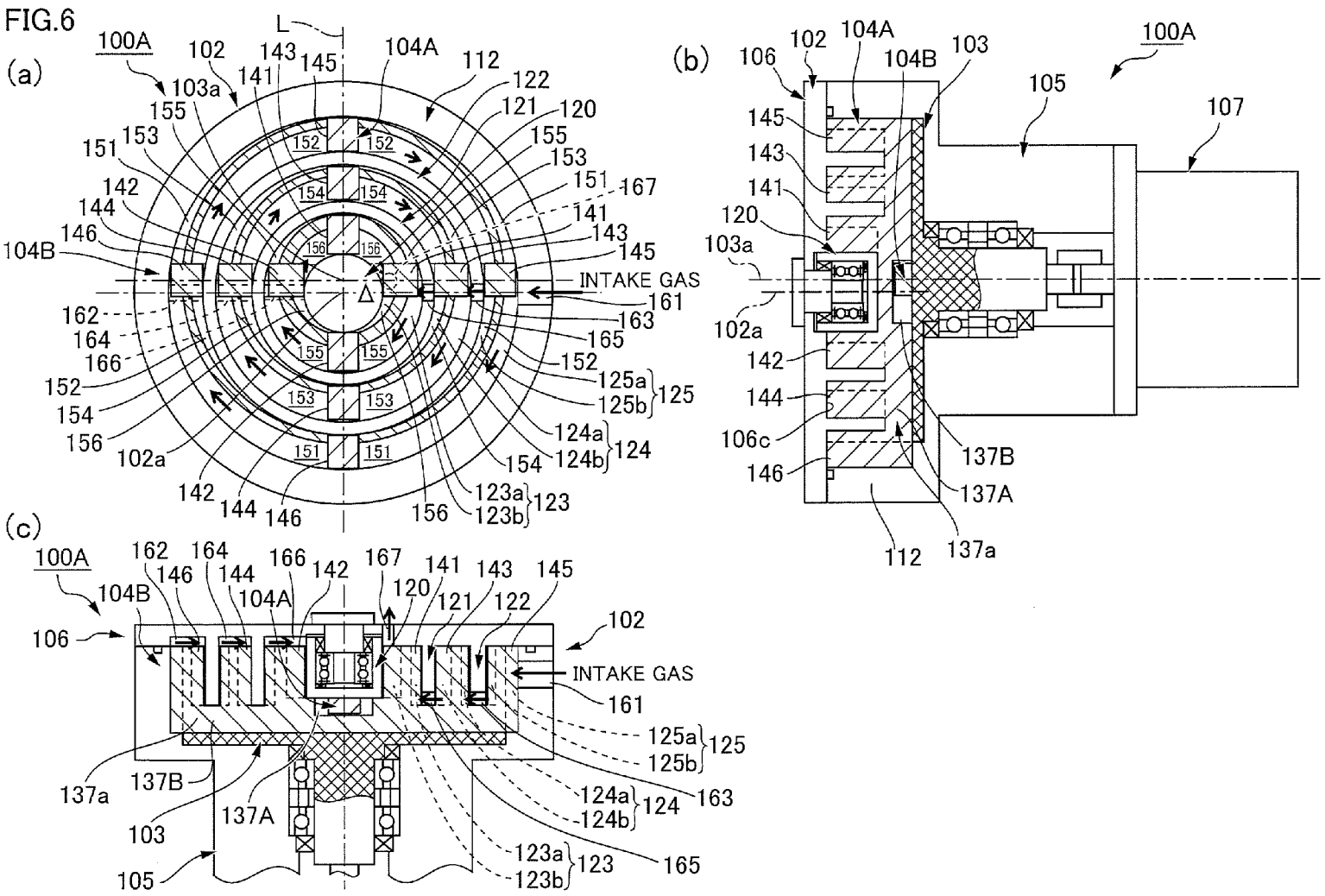
FIG. 6 (*a*) is a simplified internal configuration diagram showing a vane compressor according to a fourth embodiment of the present invention, (*b*) is a simplified cross sectional view thereof, and (*c*) is a simplified cross sectional view take in cross section orthogonal to the cross section of (*b*)

A vane compressor according to a fourth embodiment of the present invention is described with reference to FIG. 6. The basic structure of the vane compressor 100A of the present embodiment is the same as that of the vane compressor 100 according to the third embodiment; therefore portions corresponding to those of the vane compressor 100 have been assigned the same symbols, omitting description thereof. The vane compressor 100A is equipped with two vanes 104A, 104B, the vane 104A being slidably retained in a vane attachment groove 137A, and the vane 104B being slidably retained in a vane attachment groove 137B.

Specifically, the vane attachment grooves 137A, 137B extend in directions orthogonal to one another, and are respectively formed passing through the center 103*a* of the rotor 103. These vane attachment grooves 137A, 137B are respectively grooves of unchanging width extending in straight lines in diametrical directions through the rotor rotation center 103*a*, and are basically identical to the vane attachment grooves 137 discussed previously. Consequently, the groove parts 137*a* of the vane attachment grooves 137A, 137B are formed to overlap at the centers thereof.

Figure 7:
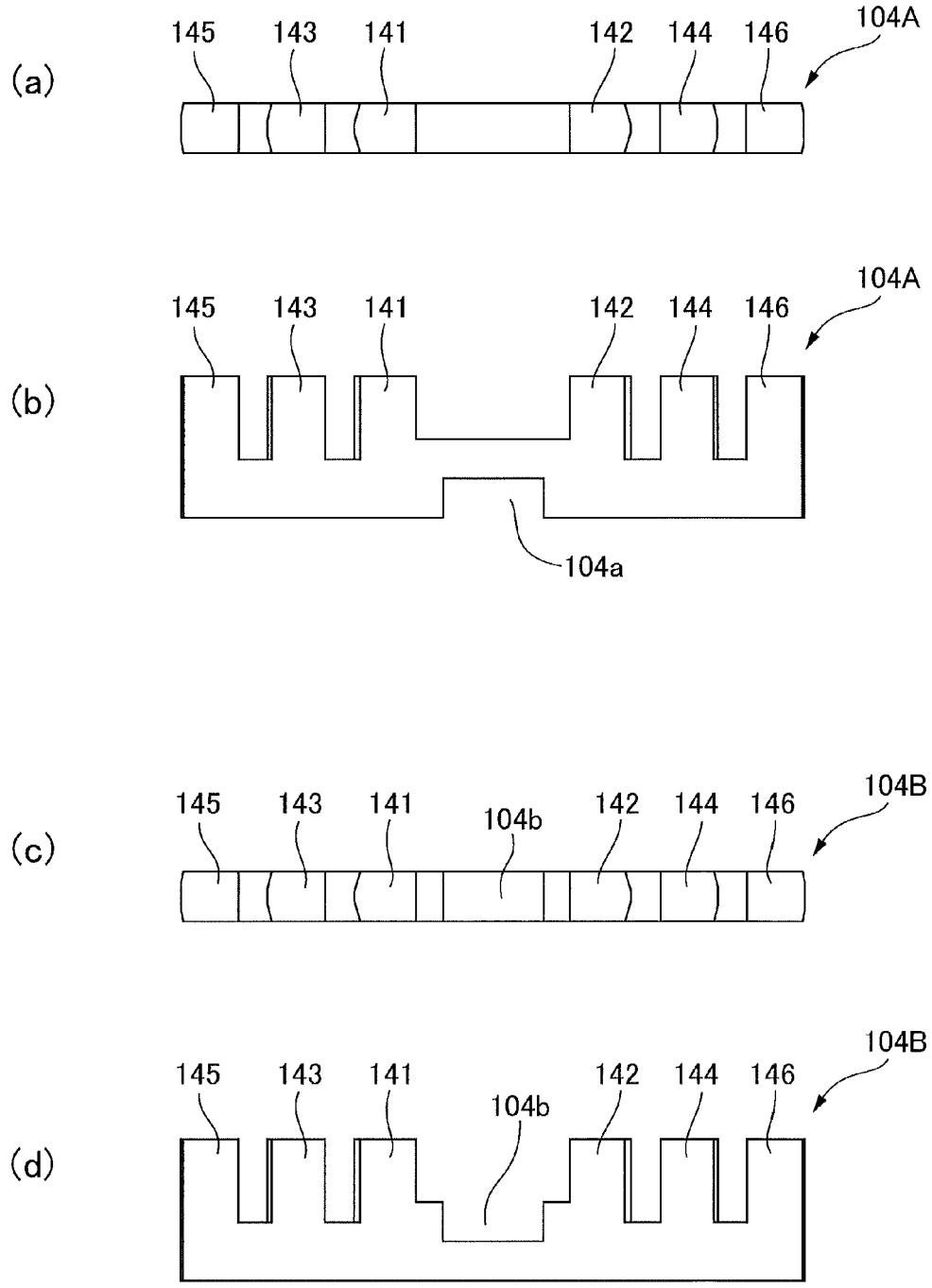
FIG. 7 (*a*) and (*b*) are a plan view and a side view showing one of the vanes of the vane compressor of FIG. 6 (*a*) and FIG. 7 (*c*) and (*d*) are a plan view and a side view showing the other vane of the vane compressor of FIG. 6 (*a*).

The following description of the vane 104A which is slidably attached in the vane attachment groove 137A and the vane 104B which is slidably attached in the vane attachment groove 137B makes reference to FIG. 7 (*a*) to (*d*). As shown in the drawings, both of the vanes 104A, 104B have identical features overall, the features being basically identical to those of the vane 104 of the vane compressor 100 of the third embodiment.

The point of difference is that rectangular cutout portions 104*a*, 104*b* are formed so as to permit the vanes 104A, 104B to be attached in an orthogonal state in the vane attachment grooves 137A, 137B. Specifically, in one of the vanes 104A, the rectangular cutout portion 104*a* is formed on the bottom side edge surface side in the lengthwise center part of the linking plate part 140 thereof, and in the other vane 104B, the rectangular cutout portion 104*b* is formed from the top side edge surface side in the lengthwise center part of the linking plate part 140 thereof.

The comb-tooth parts 141 to 146 of the two vanes 104A, 104B disposed in the orthogonal state divide, into four compression chambers respectively, the outer peripheral-side spaces 123*a*, 124*a*, 125*a* and the inner peripheral-side spaces 123*b*, 124*b*, 125*b* of the ring-shaped spaces 123, 124, 125. Specifically, as shown in FIG. 6 (*a*), the outer peripheral-side space 125*a* of the outermost ring-shaped space 125 is divided into four first-stage compression chambers 151 by the comb-tooth parts 146, 145 of the vane 104A and the comb-tooth parts 146, 145 of the vane 104B. The inner peripheral-side space 125*b* of the ring-shaped space 125 is divided into four second-stage compression chambers 152 by the comb-tooth parts 146, 145 of the vane 104A and the comb-tooth parts 146, 145 of the vane 104B.

Likewise, the outer peripheral-side space 124*a* of the ring-shaped space 124 is divided into four third-stage compression chambers 153 by the pair of comb-tooth parts 144 and the pair of comb-tooth parts 143. The inner peripheral-side space 124*b* of the ring-shaped space 124 is divided into four fourth-stage compression chambers 154 by the pair of comb-tooth parts 144 and the pair of comb-tooth parts 143. The outer peripheral-side space 123*a* of the ring-shaped space 123 is divided into four fifth-stage compression chambers 155 by the pair of comb-tooth parts 142 and the pair of comb-tooth parts 141, while the inner peripheral-side space 123*b* thereof is divided into four sixth-stage compression chambers 156 by the pair of comb-tooth parts 142 and the pair of comb-tooth parts 141.

The intake port 161, the communication ports 162 to 166, and the discharge port 167 are formed at the same positions as in the vane compressor 100 discussed previously.

In the vane compressor 100A having this feature, when the rotor 103 is rotated by the motor 107, the pair of vanes 104A, 104B rotate in tandem with the rotor 103 about the rotor rotation center 103*a* while maintaining their orthogonal state. Because the vanes 104A, 104B are respectively slidable in orthogonal diametrical directions with respect to the rotor 103, the vanes 104A, 104B, guided by the outside peripheral surface 120*a* of the vane guide 120 positioned at the rotor rotation center 103*a*, rotate while undergoing reciprocating sliding motion in diametrical directions.

As a result, the compression chambers 151 to 156 of the first to sixth stages, while in a state of being substantially sealed off by the comb-tooth parts 141 to 146 of the vanes 104A, 104B, rotate together with the rotor 103, with the volume thereof repeatedly increasing and decreasing each time that that rotor 103 rotates by 180 degrees. The fluid is thereby compressed in succession within the compression chambers 151 to 156, and compressed fluid which has been compressed to a high compression ratio is then discharged from the compression chamber 156 of the final stage. The vane compressor 100A thereby affords working effects comparable to the vane compressor 100 discussed previously.

The invention claimed is:

1. A vane compressor, comprising:

a stator;

a rotor; and vanes for dividing an interstice between the stator and the rotor into a plurality of compression chambers; wherein:

the stator is equipped, towards an outside from a center thereof, with a first circular inner peripheral surface, a circular outer peripheral surface, and a second circular inner peripheral surface arranged concentrically about the center, a ring-shaped space being formed between the circular outer peripheral surface and the second circular inner peripheral surface;

the rotor is equipped with a cylinder centered about a center thereof, and with at least one pair of vane attachment grooves that extend through the cylinder in a radial direction thereof;

the cylinder is arranged in an eccentric state in the ring-shaped space of the stator, and divides the ring-shaped space into an outer peripheral-side space and an inner peripheral-side space;

the vanes are slidably attached in the respective vane attachment grooves;

the vanes are respectively equipped with first comb-tooth parts and second comb-tooth parts formed along a radial direction of the cylinder of the rotor, at a predetermined distance from the center of the rotor;

the first comb-tooth parts are arranged to an inside of the first circular inner peripheral surface, and the second comb-tooth parts divide the outer peripheral-side space and the inner peripheral-side space respectively, into the plurality of compression chambers within the ring-shaped space; and due to centrifugal force acting on the vanes in association with rotation of the rotor, at least the first comb-tooth parts become pressed against the facing first circular inner peripheral surface, and the vanes, guided by the first circular inner peripheral surface, slide reciprocatinqly along the vane attachment grooves.

2. The vane compressor according to claim 1, wherein:

the stator is equipped, towards the outside from the center thereof, with a first cylindrical part and a second cylindrical part arranged concentrically about the center;

the first cylindrical part is formed with the first circular inner peripheral surface and the circular outer peripheral surface; and the second cylindrical part is formed with the second circular inner peripheral surface.

3. The vane compressor according to claim 2, wherein:

the stator rotatably supports the first cylindrical part about a center thereof.

4. The vane compressor according to claim 2, wherein:

the second comb-tooth parts face the second circular inner peripheral surface in a non-contacting state with the first comb-tooth parts of the vane abutting against the first circular inner peripheral surface.

5. The vane compressor according to claim 4, wherein the stator rotatably supports the first cylindrical part about a center thereof.

6. The vane compressor according to claim 4, wherein:

shapes of the first circular inner peripheral surface, the circular outer peripheral surface, and the second circular inner peripheral surface are defined by rotation trajectories of regions of the first and second comb-tooth parts of the vanes that face these surfaces, or by approximate curves of these rotation trajectories.

7. The vane compressor according to claim 6, wherein the stator rotatably supports the first cylindrical part about a center thereof.

8. A vane compressor, comprising:

a stator;

a rotor; and a vane for dividing an interstice between the stator and the rotor into a plurality of compression chambers; wherein:

the stator is equipped, towards an outside from a center thereof, with a first circular outer peripheral surface, a first circular inner peripheral surface, a second circular outer peripheral surface, and a second circular inner peripheral surface arranged concentrically about the center, a first ring-shaped space being formed between the first circular outer peripheral surface and the first circular inner peripheral surface, and a second ring-shaped space being formed between the second circular outer peripheral surface and the second circular inner peripheral surface;

the rotor is equipped, towards an outside from a center thereof, with a first cylinder and a second cylinder arranged concentrically and centered on the center, and with at least one vane attachment groove extending through the first and second cylinders in a diametrical direction thereof;

the first cylinder is arranged in an eccentric state in the first ring-shaped space, and divides the first ring-shaped space into a first outer peripheral-side space and a first inner peripheral-side space;

the second cylinder is arranged in an eccentric state in the second ring-shaped space, and divides the second ring-shaped space into a second outer peripheral-side space and a second inner peripheral-side space;

the vane is equipped with a pair of first comb-tooth parts and a pair of second comb-tooth parts formed at point-symmetrical positions with respect to the center, towards either end from the center in a lengthwise direction thereof;

the first comb-tooth parts contact the first circular outer peripheral surface from both sides, as well as dividing the first outer peripheral-side space and the first inner peripheral-side space of the first ring-shaped space into the plurality of compression chambers;

the second comb-tooth parts divide the second outer peripheral-side space and the second inner peripheral-side space of the second ring-shaped space into the plurality of compression chambers;

the stator is equipped with a cylindrical or cylindrical solid vane guide equipped with the first circular outer peripheral surface;

the stator rotatably supports the vane guide about a center thereof, and the vane slides reciprocatingly along the vane attachment grooves, due to sliding of the first comb-tooth parts of the vane along the first circular outer peripheral surface in association with rotation of the rotor.

9. The vane compressor according to claim 8, wherein:

the stator is further equipped with: a first cylindrical part arranged concentrically to an outside of the vane guide, and equipped with the first circular inner peripheral surface and the second circular outer peripheral surface; and a second cylindrical part arranged concentrically to an outside of the vane guide, and equipped with the second circular inner peripheral surface.

10. The vane compressor according to claim 9, wherein:

a width dimension (W) of an inside end surface of the first comb-tooth part of the vane abutting against the first circular outer peripheral surface of the vane guide is at least double the amount of eccentricity (Δ) between the rotor rotation center, and the center of the vane guide of the stator.

11. The vane compressor according to claim 9, wherein:

shapes of the first and second circular outer peripheral surfaces, and those of the first and second circular inner peripheral surfaces are defined by rotation trajectories of regions of the first and second comb-tooth parts of the vane that faces these surfaces, or by approximate curves of these rotation trajectories.

12. The vane compressor according to claim 11, wherein:

a width dimension (W) of an inside end surface of the first comb-tooth part of the vane abutting against the first circular outer peripheral surface of the vane guide is at least double the amount of eccentricity (Δ) between the rotor rotation center, and the center of the vane guide of the stator.

13. The vane compressor according to claim 8, wherein:

the stator has an elastic member that presses the vane guide against the vane along a direction of the center axis of the vane guide.

14. The vane compressor according to claim 13, wherein:

a width dimension (W) of an inside end surface of the first comb-tooth part of the vane abutting against the first circular outer peripheral surface of the vane guide is at least double the amount of eccentricity (Δ) between the rotor rotation center, and the center of the vane guide of the stator.

15. The vane compressor according to claim 8, wherein:

the rotor has a pair of the vane attachment grooves that intersect at a right angle at the center thereof; and the vane and a second vane are slidably attached in the respective vane attachment grooves.

16. The vane compressor according to claim 15, wherein:

a width dimension (W) of an inside end surface of the first comb-tooth part of the vane abutting against the first circular outer peripheral surface of the vane guide is at least double the amount of eccentricity (Δ) between the rotor rotation center, and the center of the vane guide of the stator.

17. The vane compressor according to claim 8, wherein:

a width dimension (W) of an inside end surface of the first comb-tooth part of the vane abutting against the first circular outer peripheral surface of the vane guide is at least double the amount of eccentricity (A) between the rotor rotation center, and the center of the vane guide of the stator.

* * * * *